US011428172B2

(12) United States Patent
Kasuya et al.

(10) Patent No.: US 11,428,172 B2
(45) Date of Patent: Aug. 30, 2022

(54) VALVE OPENING AND CLOSING TIMING CONTROL DEVICE

(71) Applicant: AISIN CORPORATION, Kariya (JP)

(72) Inventors: Yuki Kasuya, Kariya (JP); Shugo Ito, Kariya (JP); Takano Nakai, Hiroshima-ken (JP); Kenichiro Suzuki, Hiroshima-ken (JP); Yoshiyuki Kamoyama, Hiroshima-gun (JP); Toru Hirota, Hiroshima-ken (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 17/203,887

(22) Filed: Mar. 17, 2021

(65) Prior Publication Data

US 2022/0003174 A1 Jan. 6, 2022

(30) Foreign Application Priority Data

Jul. 1, 2020 (JP) ..... JP2020-114252

(51) Int. Cl.

| | |
|---|---|
| ***F01L 1/34*** | (2006.01) |
| ***F02D 13/02*** | (2006.01) |
| ***F01L 9/22*** | (2021.01) |
| ***F01L 1/344*** | (2006.01) |

(52) U.S. Cl.

CPC ..... *F02D 13/0238* (2013.01); *F01L 1/344* (2013.01); *F01L 9/22* (2021.01); *F01L 2800/03* (2013.01); *F01L 2820/032* (2013.01)

(58) Field of Classification Search

CPC ..... F02D 13/0238; F01L 1/344; F01L 9/22; F01L 2800/03; F01L 2820/032

See application file for complete search history.

(56) References Cited

U.S. PATENT DOCUMENTS

2003/0107353 A1* 6/2003 Nakamura ..... H02P 6/20 322/89
2005/0235938 A1* 10/2005 Tani ..... F01L 1/352 123/90.17
2010/0180844 A1 7/2010 Uehama et al.

FOREIGN PATENT DOCUMENTS

JP 2009013975 A 1/2009
JP 2013118782 A * 6/2013

OTHER PUBLICATIONS

Machine Translation of JP-2013118782-A (Year: 2013).*

* cited by examiner

*Primary Examiner* — Zelalem Eshete
(74) *Attorney, Agent, or Firm* — Buchanan Ingersoll & Rooney PC

(57) ABSTRACT

A valve opening and closing timing control device includes: a driving-side rotating body that rotates synchronously with a crankshaft of an internal combustion engine around a rotating shaft core; a driven-side rotating body that rotates integrally with a valve opening and closing camshaft of the internal combustion engine around the same shaft core as the rotating shaft core; a gear mechanism that sets a relative rotation phase between the driving-side rotating body and the driven-side rotating body by displacement of a meshing position; a motor that enables displacement of the meshing position of the gear mechanism by rotating a rotating shaft; and a control unit that controls the drive of the motor. The control unit intermittently performs control to energize the motor for one phase for a predetermined time after the internal combustion engine is stopped.

6 Claims, 4 Drawing Sheets

VALVE OPENING AND CLOSING TIMING CONTROL DEVICE

CROSS REFERENCE TO RELATED APPLICATIONS

This application is based on and claims priority under 35 U.S.C. § 119 to Japanese Patent Application No. 2020-114252, filed on Jul. 1, 2020, the entire content of which is incorporated herein by reference.

TECHNICAL FIELD

This disclosure relates to a valve opening and closing timing control device that sets a relative rotation phase between a driving-side rotating body and a driven-side rotating body by a driving force of a motor.

BACKGROUND DISCUSSION

Conventionally, there has been known a valve opening and closing timing control device including a driving-side rotating body that rotates synchronously with a crankshaft of an internal combustion engine around a rotating shaft core, a driven-side rotating body that rotates integrally with a valve opening and closing camshaft of the internal combustion engine around the same shaft core as the rotating shaft core, and a three-phase motor that sets a relative rotation phase between the driving-side rotating body and the driven-side rotating body (see Japanese Patent Application Publication No. 2009-013975, for example). Such an electric valve opening and closing timing control device has a faster phase control response than a hydraulic valve opening and closing timing control device, and is advantageous in setting a relative rotation phase suitable for cranking at the time of engine start.

A valve opening and closing timing control device described in Japanese Patent Application Publication No. 2009-013975 includes balancing means that balances the motor torque with the magnetism holding torque (cogging torque) and the cam torque after the internal combustion engine is stopped, and elimination means that eliminates the motor torque while it is balanced with the magnetism holding torque and the cam torque. Specifically, it is stated that the direction of the cam torque is estimated from the amount of energization of a three-phase motor and the amount of change in the relative rotation phase, and after three-phase energization of the three-phase motor is performed so that the motor torque is applied in a direction opposite to the cam torque, the amount of this three-phase energization is gradually reduced to eliminate the motor torque.

However, when the energization of the three-phase motor is stopped, an inertial force for continuing the rotation occurs in the rotating shaft of the three-phase motor, and the rotating shaft continues to rotate until this inertial force falls below the cogging torque and the cam torque. That is, in the valve opening and closing timing control device described in Japanese Patent Application Publication No. 2009-013975, even if the motor torque is eliminated while it is balanced with the cam torque and the cogging torque, the rotating shaft of the three-phase motor continues to rotate. As a result, dynamic friction becomes dominant, and the relative rotation phase continues to be displaced by the rotation of the rotating shaft until a static friction state is reached where the cogging torque exceeds the generated torque such as the cam torque. Hence, it takes time to achieve the optimum target phase when starting the engine next time.

A need thus exists for a valve opening and closing timing control device which is not susceptible to the drawback mentioned above.

SUMMARY

A valve opening and closing timing control device according to this disclosure includes: a driving-side rotating body that rotates synchronously with a crankshaft of an internal combustion engine around a rotating shaft core; a driven-side rotating body that rotates integrally with a valve opening and closing camshaft of the internal combustion engine around the same shaft core as the rotating shaft core; a gear mechanism that sets a relative rotation phase between the driving-side rotating body and the driven-side rotating body by displacement of a meshing position; a motor that enables displacement of the meshing position of the gear mechanism by rotating a rotating shaft; and a control unit that controls the drive of the motor. The control unit intermittently performs control to energize the motor for one phase for a predetermined time after the internal combustion engine is stopped.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of a valve opening and closing timing control device according to this disclosure will be described with reference to the drawings. In the present embodiment, as one example of the valve opening and closing timing control device, a valve opening and closing timing control device 100 provided on the intake side of an engine E will be described. Note, however, that this disclosure is not limited to the following embodiment, and various modifications can be made without departing from the gist of the disclosure.

Figure 1:
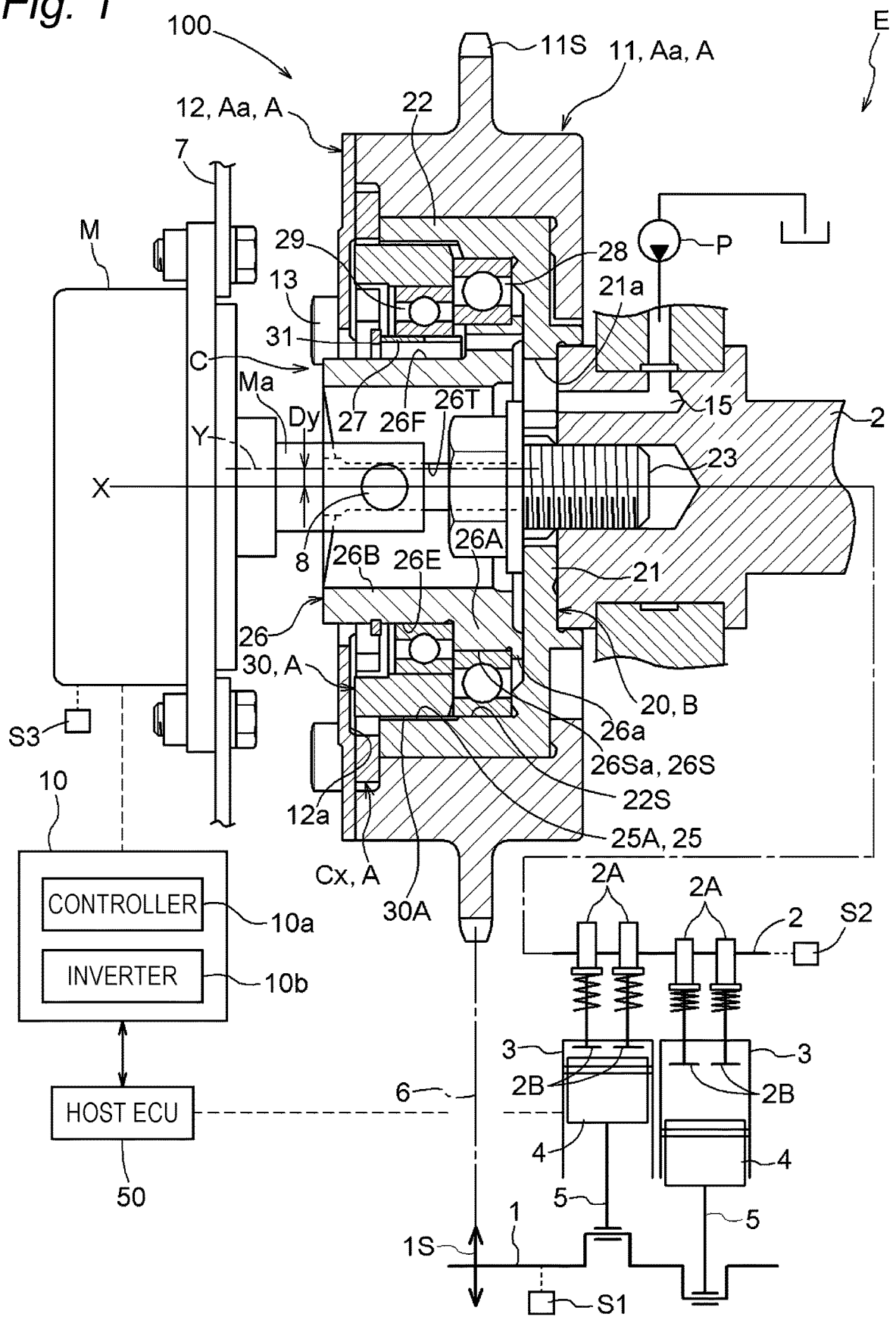
FIG. 1 is a cross-sectional view and a block diagram of a valve opening and closing timing control device.

As shown in FIG. 1, the valve opening and closing timing control device 100 includes a driving-side rotating body A that rotates synchronously with a crankshaft 1 of the engine E as an internal combustion engine around a rotating shaft core X, a driven-side rotating body B that is arranged radially inside the driving-side rotating body A and rotates integrally with a valve opening and closing intake camshaft 2 (one example of camshaft) around the rotating shaft core X, a phase control motor M formed by a three-phase motor (one example of motor) that sets the relative rotation phase between the driving-side rotating body A and the driven-side rotating body B, and a control unit 10 of the electric VVT. Hereinafter, the electric valve opening and closing timing control device 100 may be referred to as an "electric VVT".

The engine E is configured as a 4-cycle engine in which pistons 4 are housed in multiple cylinders 3 formed in a cylinder block, and the pistons 4 are connected to the crankshaft 1 by connecting rods 5. A timing chain 6 (timing belt or the like may be used instead) is wound around an output sprocket 1S of the crankshaft 1 of the engine E and a drive sprocket 11S of the driving-side rotating body A. As a result, the rotation of the crankshaft 1 of the engine E is transmitted to the driving-side rotating body A. The drive of the engine E is controlled by a host ECU 50 as a control device. The host ECU 50 is formed by software centered on a CPU that performs various processing and a memory, or collaboration between hardware and software.

As a result, when the engine E is driven, the entire valve opening and closing timing control device 100 rotates around the rotating shaft core X. Additionally, the driving force of the phase control motor M activates a phase adjusting mechanism C, which will be described later, so that the driven-side rotating body B is displaceable relative to the driving-side rotating body A in the same direction as or in the opposite direction to the rotating direction of the driving-side rotating body A. This displacement sets the relative rotation phase between the driving-side rotating body A and the driven-side rotating body B, and enables control of the opening and closing timings of intake valves 2B by cam portions 2A of the intake camshaft 2.

Note that an operation in which the driven-side rotating body B is displaced in the same direction as the rotating direction of the driving-side rotating body A is referred to as an advance operation, and the intake compression ratio is increased by this advance operation. Additionally, an operation in which the driven-side rotating body B is displaced in the opposite direction to the driving-side rotating body A is referred to as a retard operation, and the intake compression ratio is reduced by this retard operation.

[Valve Opening and Closing Timing Control Device]

The driving-side rotating body A includes a tubular main body portion Aa centered on the rotating shaft core X, an Oldham coupling Cx that rotates synchronously with the main body portion Aa, and an input gear 30. The main body portion Aa is formed by fastening an outer case 11 having the drive sprocket 11S formed on the outer periphery thereof and a front plate 12 with multiple fastening bolts 13. The outer case 11 has a bottomed tubular shape having an opening at the bottom. The Oldham coupling Cx and the input gear 30 that form a part of the driving-side rotating body A also function as the phase adjusting mechanism C described later. The input gear 30 is connected to the main body portion Aa through the Oldham coupling Cx.

An intermediate member 20 (one example of driven-side rotating body B) and the phase adjusting mechanism C having a hypocycloid gear mechanism are housed in an internal space of the outer case 11. Additionally, the phase adjusting mechanism C includes the Oldham coupling Cx that reflects the phase change on the driving-side rotating body A and the driven-side rotating body B, and this Oldham coupling Cx is arranged between the intermediate member 20 and the front plate 12 in the rotating shaft core X direction. A lubrication recess 12*a*, which is a slight gap in the rotating shaft core X direction, is formed on a surface of the front plate 12 facing the Oldham coupling Cx.

In the intermediate member 20 forming the driven-side rotating body B, a support wall portion 21 connected to the intake camshaft 2 in a posture orthogonal to the rotating shaft core X, and a tubular wall portion 22 centered on the rotating shaft core X and protruding in a direction separating from the intake camshaft 2 are formed as one body.

The intermediate member 20 is inserted so as to be relatively rotatable in a state where an outer surface of the tubular wall portion 22 is in contact with an inner surface of the outer case 11, and is fixed to an end portion of the intake camshaft 2 by a connecting bolt 23 inserted through a through hole in the center of the support wall portion 21. An opening 21*a* for guiding oil into an eccentric member 26 is formed in a part of a surface of the support wall portion 21 of the intermediate member 20 that comes into contact with the intake camshaft 2.

The phase control motor M is supported to the engine E by a support frame 7, so that the shaft core of an output shaft Ma (one example of rotating shaft) of the phase control motor M is arranged on the same shaft core as the rotating shaft core X. A pair of engaging pins 8 orthogonal to the rotating shaft core X are formed on the output shaft Ma of the phase control motor M. The phase control motor M of the present embodiment is formed by a three-phase motor, and includes a rotor (not shown) in which the output shaft Ma is fixed to an inner peripheral portion and a permanent magnet is embedded in an outer peripheral portion, and a stator (not shown) that generates magnetic flux to give a rotational force to the rotor. The stator includes stator coils (not shown) of three phases including the U phase, the V phase, and the W phase, and converts DC voltage into AC voltage by an inverter 10*b* of the control unit 10 described later to apply the AC voltage to each stator coil. The stator coils are electrically connected in a delta connection or a Y connection. Additionally, the phase control motor M is provided with a rotation angle sensor S3. Multiple rotation angle sensors S3 are provided in the rotation direction of the output shaft Ma, and detect the rotation phase and the rotation speed of the output shaft Ma.

The phase adjusting mechanism C is formed by multiple members so as to change the relative rotation phase between the driving-side rotating body A and the driven-side rotating body B by the driving force of the phase control motor M. The phase adjusting mechanism C includes the intermediate member 20, an output gear 25 (one example of gear mechanism) formed on an inner peripheral surface of the tubular wall portion 22 of the intermediate member 20, the eccentric member 26, a leaf spring 27, a first bearing 28, a second bearing 29, a fixing ring 31, the Oldham coupling Cx, and the input gear 30 (one example of gear mechanism).

On the inner circumference of the tubular wall portion 22 of the intermediate member 20, a support surface 22S centered on the rotating shaft core X is formed on the inside (position adjacent to support wall portion 21) in a direction extending along the rotating shaft core X, and the output gear 25 centered on the rotating shaft core X is integrally formed on the outside (side farther from intake camshaft 2) of the support surface 22S in the direction extending along the rotating shaft core X.

The eccentric member 26 has a tubular shape, and the eccentric member 26 has a first part 26A that supports the radially inner side of the driven-side rotating body B (intermediate member 20) to the inside (side closer to intake camshaft 2) in the direction extending along the rotating shaft core X, and a second part 26B that supports the radially inner side of the driving-side rotating body A (input gear 30) to the outside (side farther from intake camshaft 2) in the direction extending along the rotating shaft core X. The second part 26B has an eccentric support surface 26E that is an outer peripheral surface centered on an eccentric shaft core Y parallel to the rotating shaft core X and displaced from the rotating shaft core X by a predetermined eccentricity Dy. The leaf spring 27 is fitted into a recess 26F formed on the outer circumference of the eccentric support surface 26E. Additionally, the first part 26A has a protrusion 26S that protrudes farther to the radially outer side than a radially outer surface of the leaf spring 27. A circumferential support surface 26Sa centered on the rotating shaft core X is formed on an outer peripheral surface of the protrusion 26S.

On the inner circumference of the eccentric member 26, a pair of engaging grooves 26T to which the pair of engaging pins 8 of the phase control motor M can be engaged are formed so as to be parallel to the rotating shaft core X. Moreover, an annular projection 26*a* protruding radially outward is formed at an end portion of the eccentric member 26 on the inside (side of support wall portion 21) in the direction extending along the rotating shaft core X. The projection 26*a* is sandwiched between the support wall portion 21 of the driven-side rotating body B and the first bearing 28 in the direction extending along the rotating shaft core X, and has a function of preventing the eccentric member 26 from coming off.

In the phase adjusting mechanism C, the number of teeth of an external tooth portion 30A of the input gear 30 is set to be one tooth less than the number of teeth of an internal tooth portion 25A of the output gear 25. Then, a part of the external tooth portion 30A of the input gear 30 meshes with a part of the internal tooth portion 25A of the output gear 25 to form a gear mechanism. The leaf spring 27 adds an energizing force to the input gear 30 so that a part of the external tooth portion 30A of the input gear 30 meshes with a part of the internal tooth portion 25A of the output gear 25. The energizing force of the leaf spring 27 can eliminate backlash at the meshing portion between the input gear 30 and the output gear 25.

The fixing ring 31 is a C-shaped annular member, and is fixed in a fitted state on the outside (side farther from intake camshaft 2) of the eccentric support surface 26E of the eccentric member 26 in the rotating shaft core X direction to prevent the second bearing 29 from coming off.

The Oldham coupling Cx is formed by a plate-shaped coupling member, and a pair of external engaging arms (not shown) are engaged with the outer case 11, and a pair of internal engaging arms (not shown) are engaged with the input gear 30. The Oldham coupling Cx is displaceable in a first direction (direction orthogonal to rotating shaft core X) in which the external engaging arms protrude toward the outer case 11, and the input gear 30 is freely displaceable with respect to the Oldham coupling Cx in a second direction (direction orthogonal to rotating shaft core X and first direction) extending along the direction in which the internal engaging arms are formed.

Lubricating oil supplied from an oil pump P is supplied from a lubricating oil passage 15 of the intake camshaft 2 to an internal space of the eccentric member 26 through the opening 21*a* of the support wall portion 21 of the intermediate member 20. The lubricating oil supplied in this way is supplied to the first bearing 28 through a gap between the projection 26*a* of the eccentric member 26 and the support wall portion 21 of the driven-side rotating body B by centrifugal force, and allows the first bearing 28 to operate smoothly. At the same time, by centrifugal force, the lubricating oil in the internal space of the eccentric member 26 is supplied to the Oldham coupling Cx, and is also supplied to the second bearing 29 to be supplied to a part between the internal tooth portion 25A of the output gear 25 and the external tooth portion 30A of the input gear 30. Then, the lubricating oil supplied to the Oldham coupling Cx is discharged to the outside through a gap between the Oldham coupling Cx and the outer case 11.

With the above configuration, the support wall portion 21 of the intermediate member 20 is connected to the end portion of the intake camshaft 2 by the connecting bolt 23, and the intake camshaft 2 and the intermediate member 20 rotate integrally. The eccentric member 26 is supported by the first bearing 28 so as to be freely rotatable around the rotating shaft core X, relative to the intermediate member 20. The input gear 30 is supported to the eccentric support surface 26E of the eccentric member 26 through the second bearing 29, and a part of the external tooth portion 30A of the input gear 30 is meshed with a part of the internal tooth portion 25A of the output gear 25 by the energizing force of the leaf spring 27. Additionally, since the front plate 12 is arranged on the outside of the Oldham coupling Cx, the Oldham coupling Cx is movable in a direction orthogonal to the rotating shaft core X while being in contact with an inner surface of the front plate 12. Moreover, the pair of engaging pins 8 formed on the output shaft Ma of the phase control motor M are engaged with the engaging grooves 26T of the eccentric member 26.

The phase control motor M is controlled by the control unit 10. The engine E includes a crank sensor S1 and a cam sensor S2 that can detect the rotation speed (number of revolutions per unit time) and the rotation phase of the crankshaft 1 and the intake camshaft 2, and inputs the detection signals of these sensors to the host ECU 50. Upon receipt of a phase command to maintain the relative rotation phase from the host ECU 50, the control unit 10 maintains the relative rotation phase by driving the phase control motor M at a speed equal to the rotation speed of the intake camshaft 2 when the engine E is driven. On the other hand, upon receipt of a phase command to displace the relative rotation phase from the host ECU 50, the control unit 10 performs an advance operation by reducing the rotation speed of the phase control motor M from the rotation speed of the intake camshaft 2, or conversely, performs a retard operation by increasing the rotation speed of the phase control motor M.

When the phase control motor M rotates at the same speed as the outer case 11 (same speed as intake camshaft 2), the meshing position of the external tooth portion 30A of the input gear 30 with the internal tooth portion 25A of the output gear 25 does not change. Hence, the relative rotation phase of the driven-side rotating body B with respect to the driving-side rotating body A is maintained.

On the other hand, by driving and rotating the output shaft Ma of the phase control motor M at a higher or lower speed than the rotation speed of the outer case 11 so as to be proportional to the reduction ratio of the gear mechanism, the eccentric shaft core Y of the phase adjusting mechanism C revolves around the rotating shaft core X. This revolution causes the displacement of the meshing position of the external tooth portion 30A of the input gear 30 with the internal tooth portion 25A of the output gear 25 along the inner circumference of the output gear 25, and a rotational force acts between the input gear 30 and the output gear 25. That is, a rotational force centered on the rotating shaft core X acts on the output gear 25, and a rotational force for rotating around the eccentric shaft core Y acts on the input gear 30.

As described above, the input gear 30 engages with the internal engaging arms of the Oldham coupling Cx, and therefore does not rotate with respect to the outer case 11, and the rotational force of the main body portion Aa of the driving-side rotating body A acts on the output gear 25. Due to the action of this rotational force, the intermediate member 20 together with the output gear 25 rotates around the rotating shaft core X with respect to the outer case 11. As a result, the relative rotation phase between the driving-side rotating body A and the driven-side rotating body B is set, and the opening and closing timing by the intake camshaft 2 is set.

Additionally, when the eccentric shaft core Y of the input gear 30 revolves around the rotating shaft core X, the displacement of the input gear 30 causes displacement of the Oldham coupling Cx in the direction (first direction) in which the external engaging arms protrude toward the outer case 11, and displacement of the input gear 30 in the direction (second direction) in which the internal engaging arms protrude.

As described above, the number of teeth of the external tooth portion 30A of the input gear 30 is set to be one tooth less than the number of teeth of the internal tooth portion 25A of the output gear 25. Hence, by rotating the output shaft Ma of the phase control motor M by the reduction ratio of the gear mechanism, one revolution of the eccentric shaft core Y of the input gear 30 around the rotating shaft core X causes rotation of the output gear 25 for one tooth, whereby a large deceleration is achieved.

[Electric VVT Control Unit]

The control unit 10 has a controller 10*a* that controls the drive of the phase control motor M, and the inverter 10*b* that receives a phase command from the controller 10*a* and applies an AC voltage to each phase of the phase control motor M. The control unit 10 is electrically connected to the host ECU 50 that controls the drive of the engine E through a wire such as a cable. Hence, the control unit 10 and the host ECU 50 are capable of transmitting and receiving various information to and from each other. Note that the control unit 10 and the host ECU 50 may be capable of performing wireless communication. Each functional unit of the control unit 10 is formed by software centered on a CPU that performs various processing and a memory, or collaboration between hardware and software.

The host ECU 50 transmits, to the control unit 10, the current relative rotation phase (actual phase) obtained from the crank sensor S1 that detects the rotation position of the crankshaft 1 and the cam sensor S2 that detects the rotation phase of the intake camshaft 2, and a target phase which is the optimum relative rotation phase set according to the operating state of the engine E. The controller 10*a* receives a phase command from the host ECU 50 that controls the drive of the engine E, controls the drive of the phase control motor M (rotation speed of output shaft Ma) so that the current relative rotation phase reaches the target phase, and sets the relative rotation phase of the driven-side rotating body B with respect to the driving-side rotating body A.

The controller 10*a* transmits a drive signal to each switching element (not shown) of the inverter 10*b*, and controls the amount of energization of the three stator coils of the U phase, V phase, and W phase of the phase control motor M. While the engine E is being driven, the energization amount is controlled on the basis of the actual phase and target phase received from the host ECU 50. On the other hand, when the engine E is stopped, the controller 10*a* controls the amount of energization of the inverter 10*b* so as to achieve the optimum target phase (e.g., most retarded angle phase) at the next start, and stops energizing the phase control motor M when the target phase is achieved. At this time, the inertial force for continuing rotation of the intake camshaft 2 and the inertial force for continuing rotation of the phase control motor M exceed the cogging torque, the intake camshaft 2 does not stop, and the relative rotation phase is displaced by the cam torque (see broken line of "relative rotation phase" in FIG. 2). As a result, it takes time to reach the optimum target phase the next time the engine E is started.

Figure 2:
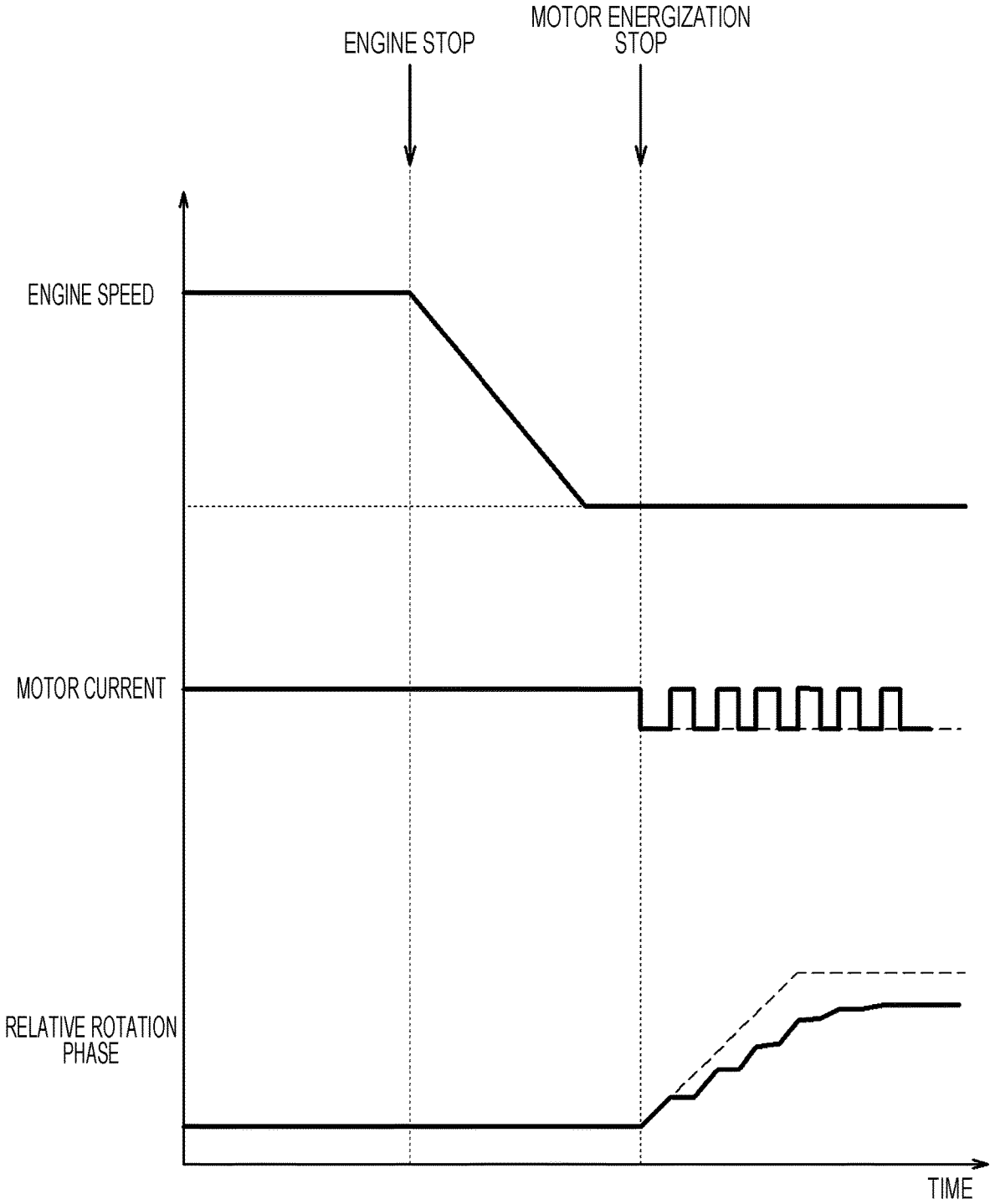
FIG. 2 is a conceptual diagram showing a control mode when the engine is stopped.

For this reason, the controller 10*a* of the present embodiment intermittently performs control to energize the phase control motor M for one phase for a predetermined time (e.g., 50 ms) after the engine E is stopped. FIG. 2 shows one example of energization control of the phase control motor M by the controller 10*a*. As shown in FIG. 2, after the engine E is stopped, the controller 10*a* controls the amount of energization of the inverter 10*b* so as to achieve the optimum target phase (e.g., most retarded angle phase) at the next start, and stops energizing the phase control motor M when the target phase is achieved. Then, the controller 10*a* transmits a drive signal to each switching element of the inverter 10*b* to energize one of the three phases of the U phase, V phase, and W phase of the phase control motor M. When this one-phase energization is performed, the output shaft Ma of the phase control motor M stops at the position of the energized phase, and by fixing the meshing position of the gear mechanism (input gear 30 and output gear 25) against the cam torque, the displacement of the relative rotation phase can be stopped.

Next, the controller 10*a* stops energizing the phase control motor M. As a result, the output shaft Ma of the phase control motor M and the intake camshaft 2 resume rotation due to inertial force, and the meshing position of the gear mechanism (input gear 30 and output gear 25) changes due to the cam torque, resulting in displacement of the relative rotation phase (e.g., displacement to advance side). Next, the controller 10*a* transmits a drive signal to each switching element of the inverter 10*b* again, to energize one of the three phases of the U phase, the V phase, and the W phase of the phase control motor M. The controller 10*a* repeats the one-phase energization and energization stop of the phase control motor M multiple times (six times in present embodiment), and stops the energization of the phase control motor M completely. The controller 10*a* of the present embodiment controls the interval between the one-phase energization and the next one-phase energization on the basis of the time (e.g., 60 ms).

While the energization of the phase control motor M is stopped and the output shaft Ma of the phase control motor M is rotating, the dynamic friction becomes dominant and the relative rotation phase is displaced. However, when the cogging torque of the phase control motor M exceeds the generated torque such as the cam torque, a static friction state occurs, and the displacement of the relative rotation phase stops.

That is, in the present embodiment, as indicated by the solid line of "relative rotation phase" in FIG. 2, the displacement of the relative rotation phase is stopped by the one-phase energization of the phase control motor M, and this one-phase energization is intermittently performed. Consequently, it is possible to curb the displacement of the relative rotation phase from the dynamic friction state to the static friction state as compared with the conventional example indicated by the broken line of "relative rotation phase" in FIG. 2 in which the one-phase energization is not performed. As a result, the relative rotation phase can be promptly displaced to the target phase at the next start of the engine E, and the relative rotation phase can be reliably displaced to the target phase suitable for cranking before the ignition switch is turned on and the engine E starts cranking.

Figure 3:
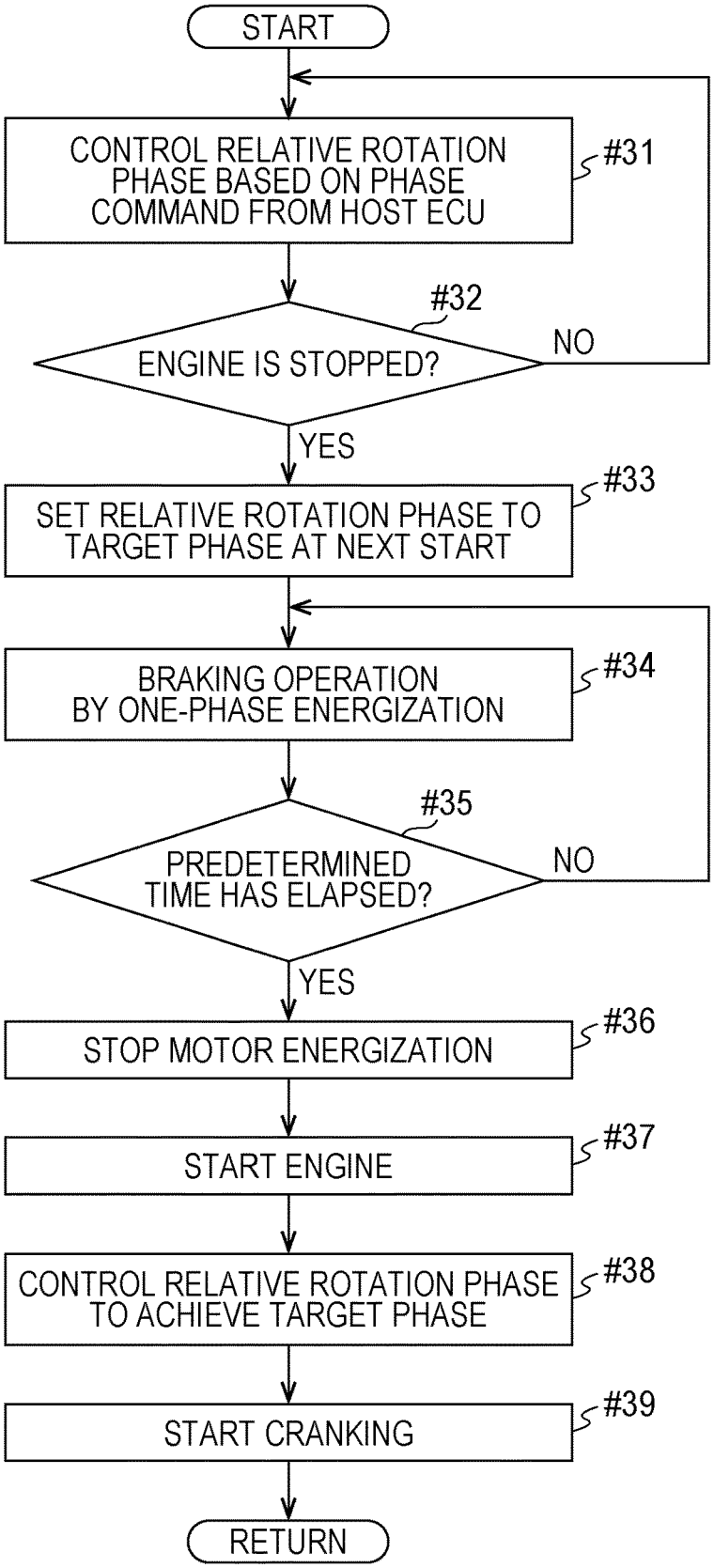
FIG. 3 is a diagram showing a control flow of the valve opening and closing timing control device.

FIG. 3 shows a control flow of the valve opening and closing timing control device 100 according to the present embodiment. When the engine E is being driven, the controller 10*a* of the valve opening and closing timing control device 100 controls the relative rotation phase on the basis of a phase command from the host ECU 50 (#31). Then, when the ignition switch is turned off and the engine E is stopped (#32 YES), based on the phase command from the host ECU 50, the controller 10*a* controls the amount of energization of the inverter 10*b* so as to achieve the optimum target phase (e.g., most retarded angle phase) at the next start, and stops energizing the phase control motor M when the target phase is achieved (#33).

Next, after the engine E is stopped, the controller 10*a* performs a braking operation of intermittently performing control to energize the phase control motor M for one phase for a predetermined time (e.g., 50 ms) (#34). The interval between this one-phase energization and the next one-phase energization is controlled on the basis of time (e.g., 60 ms). Then, when a predetermined time (e.g., 600 ms) elapses (#35 YES) from the start of the intermittent control of one-phase energization by the controller 10*a*, the energization of the phase control motor M is completely stopped (#36). Then, when the ignition switch is turned on and the engine E is started (#37), based on the phase command from the host ECU 50, the controller 10*a* controls the phase control motor M and displaces the relative rotation phase so as to achieve a target phase (e.g., most retarded angle phase) suitable for cranking, and cranking is started (#38, #39). As described above, since the controller 10*a* can curb displacement of the relative rotation phase from the dynamic friction state to the static friction state, it is possible to reliably displace the relative rotation phase to a target phase suitable for cranking at the next start of the engine E.

Figure 4:
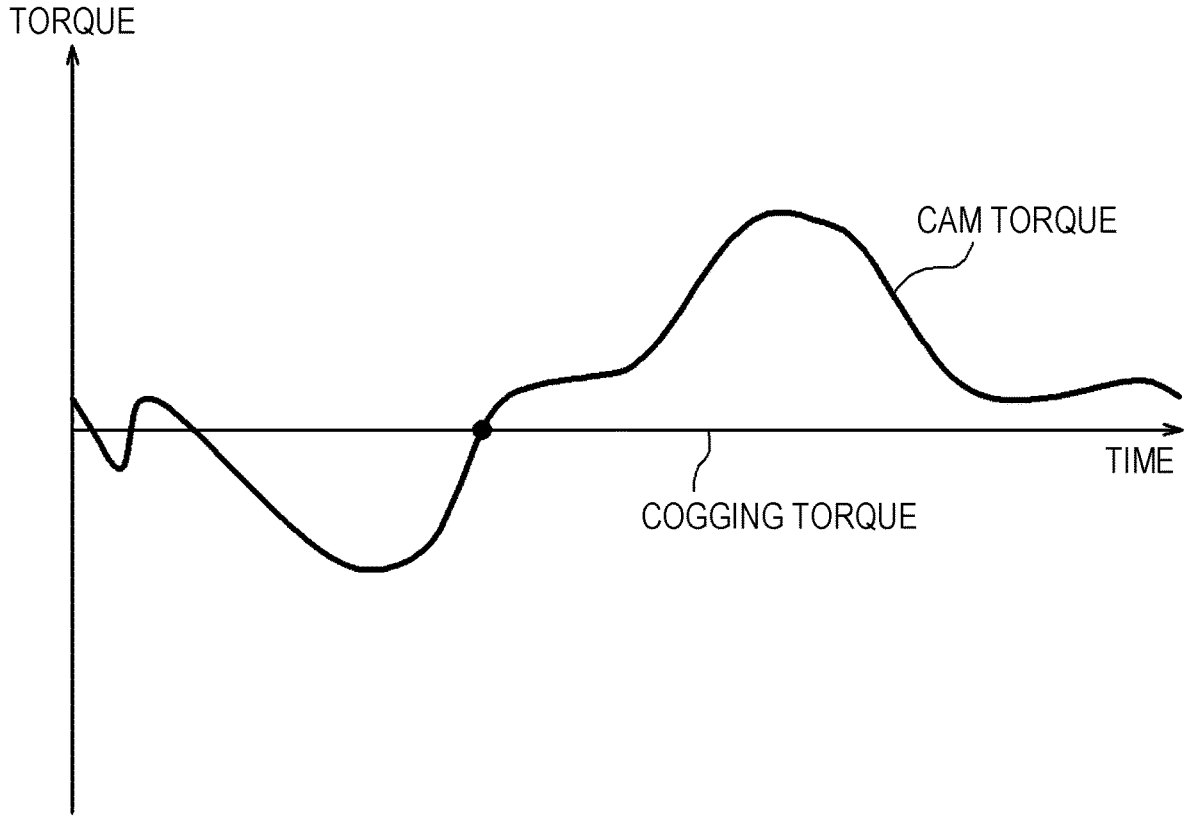
FIG. 4 is a conceptual diagram showing the relationship between cogging torque and cam torque.

Other Embodiments (1) The controller 10*a* may control the interval between the one-phase energization of the phase control motor M and the next one-phase energization on the basis of the rotation angle of the phase control motor M detected by the rotation angle sensor S3. By thus controlling the interval for performing one-phase energization on the basis of the rotation angle of the phase control motor M, the output shaft Ma of the phase control motor M can be stopped at the timing of performing one-phase energization, whereby displacement of the relative rotation phase can be stopped reliably. Additionally, if the rotation of the output shaft Ma is stopped at the timing when the cogging torque and the cam torque cross (timing when cam torque and cogging torque are balanced) in the static friction state shown in FIG. 4, the cam torque can be eliminated effectively and the time required to shift from the dynamic friction state to the static friction state can be shortened. As a result, displacement of the relative rotation phase due to the cam torque can be curbed effectively.

(2) The controller 10*a* may determine the phase of the phase control motor M to be subjected to one-phase energization on the basis of the rotation angle of the phase control motor M detected by the rotation angle sensor S3. By thus determining the phase of the phase control motor M to be subjected to one-phase energization on the basis of the rotation angle of the phase control motor M, the time required for the output shaft Ma of the phase control motor M to stop can be shortened, whereby displacement of the relative rotation phase can be curbed even more.

(3) The controller 10*a* may sequentially perform one-phase energization for the phases of the phase control motor M. By thus performing one-phase energization in the order of the phases, a stopped state of the output shaft Ma can be created effectively without detecting the rotation angle of the output shaft Ma of the phase control motor M.

(4) The rotation angle of the phase control motor M may be estimated from the detected values of the crank sensor S1 and the cam sensor S2. (5) The valve opening and closing timing control device 100 as the electric VVT is not limited to the above-described embodiment, and may have any configuration as long as the relative rotation phase is displaced by an electric actuator. (6) The phase control motor M is not particularly limited as long as it includes multiple phases, such as a brushless DC motor, an AC induction motor, and an AC synchronous motor.

A characteristic configuration of the valve opening and closing timing control device according to this disclosure includes: a driving-side rotating body that rotates synchronously with a crankshaft of an internal combustion engine around a rotating shaft core; a driven-side rotating body that rotates integrally with a valve opening and closing camshaft of the internal combustion engine around the same shaft core as the rotating shaft core; a gear mechanism that sets a relative rotation phase between the driving-side rotating body and the driven-side rotating body by displacement of a meshing position; a motor that enables displacement of the meshing position of the gear mechanism by rotating a rotating shaft; and a control unit that controls the drive of the motor. The control unit intermittently performs control to energize the motor for one phase for a predetermined time after the internal combustion engine is stopped.

When the internal combustion engine stops, even if the relative rotation phase is set to the optimum target phase at the next start, the inertial force for continuing rotation of the camshaft and the inertial force for continuing rotation of the motor exceed the cogging torque, the camshaft does not stop, and the relative rotation phase is displaced by the cam torque. As a result, it takes time to reach the optimum target phase the next time the internal combustion engine is started.

For this reason, in this configuration, after the internal combustion engine is stopped, control for energizing the motor for one phase for a predetermined time is performed intermittently. When one-phase energization is performed, the rotating shaft of the motor stops at the position of the energized phase, and the displacement of the relative rotation phase can be stopped by fixing the meshing position of the gear mechanism against the cam torque. When the one-phase energization is cancelled, the rotating shaft and camshaft resume rotation due to inertial force, and the relative rotation phase is displaced by the cam torque. While the rotating shaft of the motor is rotating, the dynamic friction becomes dominant and the relative rotation phase is displaced. However, when the cogging torque of the motor exceeds the generated torque such as the cam torque, a static friction state occurs, and the displacement of the relative rotation phase stops.

That is, by stopping displacement of the relative rotation phase by one-phase energization and performing the one-phase energization intermittently as in this configuration, it is possible to curb displacement of the relative rotation phase between the dynamic friction state and the static friction state. As a result, the relative rotation phase can be promptly displaced to the target phase at the next start of the internal combustion engine, and the relative rotation phase can be reliably displaced to the target phase suitable for cranking before the ignition switch is turned on and the internal combustion engine starts cranking.

As described above, it is possible to provide a valve opening and closing timing control device that can curb displacement of the relative rotation phase when the engine is stopped to promptly shift to the target phase when the engine is started.

Another characteristic configuration is that the control unit controls the interval between the one-phase energization and the next one-phase energization on the basis of time.

By controlling the interval for performing one-phase energization on the basis of time as in this configuration, the control mode is simplified.

Another characteristic configuration is that the control unit controls the interval between the one-phase energization and the next one-phase energization on the basis of the rotation angle of the motor.

By controlling the interval for performing one-phase energization on the basis of the rotation angle of the motor as in this configuration, the rotating shaft can be stopped at the timing of performing one-phase energization, whereby displacement of the relative rotation phase can be stopped reliably. Additionally, if the rotation of the rotating shaft is stopped at the timing when the cam torque and the cogging torque are balanced, the cam torque can be eliminated effectively and the time required to shift from the dynamic friction state to the static friction state can be shortened. As a result, displacement of the relative rotation phase can be curbed effectively.

Another characteristic configuration is that the control unit determines the phase of the motor to be subjected to the one-phase energization on the basis of the rotation angle.

By determining the phase of the motor to be subjected to one-phase energization on the basis of the rotation angle as in this configuration, the time required for the rotating shaft to stop can be shortened, whereby displacement of the relative rotation phase can be curbed even more.

Another characteristic configuration is that the control unit sequentially performs the one-phase energization for the phases of the motor.

By performing one-phase energization in the order of the phases as in this configuration, a stopped state of the rotating shaft can be created effectively without detecting the rotation angle of the rotating shaft.

This disclosure can be used in a valve opening and closing timing control device that sets a relative rotation phase between a driving-side rotating body and a driven-side rotating body by a driving force of a motor.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening and closing timing control device comprising:

a driving-side rotating body that rotates synchronously with a crankshaft of an internal combustion engine around a rotating shaft core;

a driven-side rotating body that rotates integrally with a valve opening and closing camshaft of the internal combustion engine around the same shaft core as the rotating shaft core;

a gear mechanism that sets a relative rotation phase between the driving-side rotating body and the driven-side rotating body by displacement of a meshing position;

a motor that enables displacement of the meshing position of the gear mechanism by rotating a rotating shaft; and a control unit that controls the drive of the motor, wherein the control unit intermittently performs control to energize the motor for one phase, with an interval between a one-phase energization and a next one-phase energization during which the motor is stopped, for a predetermined time after the internal combustion engine is stopped.

2. The valve opening and closing timing control device according to claim 1, wherein the control unit controls the interval between the one-phase energization and the next one-phase energization on the basis of time.

3. The valve opening and closing timing control device according to claim 1, wherein the control unit controls the interval between the one-phase energization and the next one-phase energization on the basis of the rotation angle of the motor.

4. The valve opening and closing timing control device according to claim 3, wherein the control unit determines the phase of the motor to be subjected to the one-phase energization on the basis of the rotation angle.

5. The valve opening and closing timing control device according to claim 1, wherein the control unit sequentially performs the one-phase energization for the phases of the motor.

6. The valve opening and closing timing control device according to claim 2, wherein the control unit sequentially performs the one-phase energization for the phases of the motor.

* * * * *